US007673602B2

(12) United States Patent
Masegi

(10) Patent No.: US 7,673,602 B2
(45) Date of Patent: Mar. 9, 2010

(54) VARIABLE VALVE MECHANISM

(75) Inventor: Kiyoshi Masegi, Nishio (JP)

(73) Assignee: Otics Corporation, Nishio-shi, Aichi-ken (JP)

( * ) Notice: Subject to any disclaimer, the term of this patent is extended or adjusted under 35 U.S.C. 154(b) by 133 days.

(21) Appl. No.: 12/081,089

(22) Filed: Apr. 10, 2008

(65) Prior Publication Data

US 2008/0257291 A1 Oct. 23, 2008

(30) Foreign Application Priority Data

Apr. 19, 2007 (JP) ..... 2007-110439

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.39, 90.44, 90.6; 29/888.1, 888.2; 74/559, 567, 569
See application file for complete search history.

(56) References Cited

U.S. PATENT DOCUMENTS 6,340,010 B1 * 1/2002 Hara et al. ..... 123/90.16

FOREIGN PATENT DOCUMENTS

JP 2002-21518 1/2002
JP 2005-23803 1/2005

* cited by examiner

*Primary Examiner*—Ching Chang
(74) *Attorney, Agent, or Firm*—McGinn IP Law Group, PLLC

(57) ABSTRACT

A variable valve mechanism includes a low-speed cam, a high-speed cam, a low-speed rocker arm driven by the low-speed cam, a high-speed rocker arm driven by the high-speed cam, and a switching mechanism. A cam profile of the high-speed cam is set such that it does not exceed a cam profile of the low-speed cam. During low-speed operation, the switching mechanism links the low-speed and the high-speed rocker arms such that the low-speed cam causes the high-speed rocker arm to rock together with the low-speed rocker arm and to open and close a valve. During high-speed operation, the switching mechanism de-links the low-speed rocker arm and the high-speed rocker arm such that the low-speed cam causes the low-speed rocker arm to rock idly and the high-speed cam causes the high-speed rocker arm to rock independently and to open and close the valve. The cam profile of the low-speed cam is set such that the valve closes later than it does with the cam profile of the high-speed cam.

3 Claims, 5 Drawing Sheets

VARIABLE VALVE MECHANISM

INCORPORATION BY REFERENCE

The present application claims priority under 35 U.S.C. §119 to Japanese Patent Application No. 2007-110439 filed on Apr. 19, 2007, which is incorporated herein by reference in its entirety.

TECHNICAL FIELD

The present invention relates to a variable valve mechanism that switches an amount of valve lift and valve opening and closing timings by linking and de-linking a plurality of rocker arms in an internal combustion engine.

BACKGROUND OF THE INVENTION

A type of variable valve mechanism is known that performs linking and de-linking between a low-speed rocker arm that depresses a valve and a high-speed rocker arm that does not directly depress a valve.

(a) For example, in a variable valve mechanism disclosed in Japanese Patent Application Publication No. JP-A-2005-23803, a nose of a high-speed cam is set higher than that of a low-speed cam, and during low-speed operation, the two rocker arms are de-linked, with only the low-speed rocker arm being rocked by the low-speed cam and opening and closing the valve. Further, during high-speed operation, the two rocker arms are linked into a single unit that is rocked through a larger range by the high-speed cam than during low-speed operation, thus changing the amount of valve lift.

However, because this variable valve mechanism rocks both of the rocker arms as a single unit during high-speed operation, the inertial mass becomes greater than during low-speed operation. Because the inertial mass becomes greater, the need arises to increase the valve spring load in order to reach the target revolution speed of the internal combustion engine. This results in increased friction when the valve is being driven, which diminishes performance and worsens fuel economy. It also becomes necessary for the rocker arms and cam followers to have sufficient strength to bear high loads, which increases the cost.

(b) In a variable valve mechanism disclosed in Japanese Patent Application Publication No. JP-A-2002-21518, a nose of a high-speed cam is set higher than that of a low-speed cam, in the same manner as the variable valve mechanism described above, but during low-speed operation, the two rocker arms are linked into a single unit and open and close the valve by being rocked by the low-speed cam. Further, the two rocker arms are de-linked during high-speed operation, such that only the high-speed rocker arm is rocked through a larger range by the high-speed cam than during low-speed operation, thus changing the amount of valve lift.

A switching mechanism that is provided in the variable valve mechanism links the two rocker arms into a single unit and rocks them during low-speed operation, but the configuration is such that the high-speed cam does not have any effect on the rocking. Specifically, the high-speed rocker arm is provided with a follower that slides against the high-speed cam and with a follower hole. During low-speed operation, the follower slides idly within the follower hole such that the high-speed cam does not have any effect on the high-speed rocker arm. During high-speed operation, the switching mechanism uses a switching pin to cause the follower not to slide idly, such that the high-speed cam causes the high-speed rocker arm to rock.

However, the variable valve mechanism must be provided not only with the switching mechanism for the rocker arms, but also with a mechanism that controls the movement of the follower, which makes the structure more complex.

SUMMARY OF THE INVENTION

The object of the present invention is to provide a variable valve mechanism that makes an inertial mass during high-speed operation less than an inertial mass during low-speed operation using a simple structure.

The present invention aims to vary the opening and closing timings of a valve rather than aiming to vary an amount of valve lift. However, in the present invention, it is desirable for the tip of the high-speed cam nose to be as high as possible in order to ensure a sufficient amount of valve lift during high-speed operation.

In order to address the problems described above, the variable valve mechanism according to the present invention includes a low-speed cam and a high-speed cam that are arranged in parallel, a low-speed rocker arm that is driven by the low-speed cam and a high-speed rocker arm that is driven by the high-speed cam, the two rocker arms also being arranged in parallel, and a switching mechanism. A cam profile of the high-speed cam is set such that it does not exceed a cam profile of the low-speed cam. During low-speed operation, the switching mechanism links the low-speed rocker arm and the high-speed rocker arm such that the low-speed cam causes the high-speed rocker arm to rock together with the low-speed rocker arm and to open and close the valve. While during high-speed operation, the switching mechanism de-links the low-speed rocker arm and the high-speed rocker arm such that the low-speed cam causes the low-speed rocker arm to rock idly and the high-speed cam causes the high-speed rocker arm to rock independently and to open and close the valve. The cam profile of the low-speed cam is set such that the valve closes later than it does with the cam profile of the high-speed cam.

There is no particular limit on the definitions of high-speed operation and low-speed operation, but an example of high-speed operation may be operation at a revolution speed of 3000 rpm or higher, and an example of low-speed operation may be operation at a lower revolution speed. In this case, although there is no particular limit on the definition of high-speed operation, high-speed operation may also include operation when the throttle angle is large, even when the revolution speed is less than 3000 rpm.

Furthermore, there is no particular limit on the difference in the heights of the cam noses, but it is desirable for the difference in the heights of the cam noses to be small in order to ensure a sufficient amount of valve lift during high-speed operation. The heights of the cam noses may be the same, but it is more desirable for there to be a slight difference in the heights so that the cam nose of the high-speed cam will not contact the arm during low-speed operation. An example of a desirable value for the difference may be 0.1 to 0.6 mm.

Using a simple structure, the variable valve mechanism according to the present invention can make the inertial mass during high-speed operation lower than during low-speed operation. In addition, closing the valve later during low-speed operation can reduce pumping loss and improve fuel economy.

DETAILED DESCRIPTION OF THE INVENTION

Figure 1:
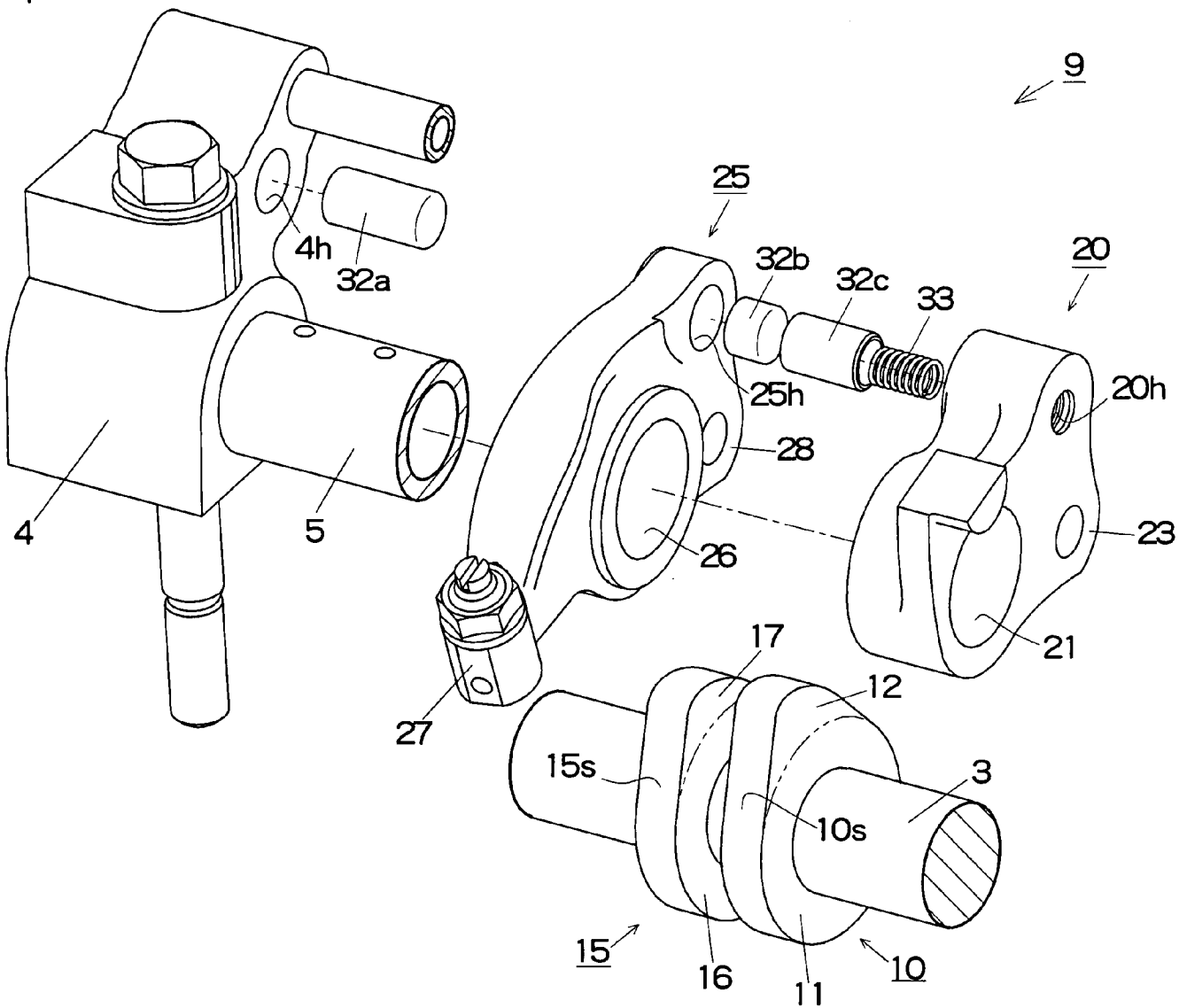
FIG. 1 is an exploded oblique view that shows a variable valve mechanism according to the present invention.
Figure 2:
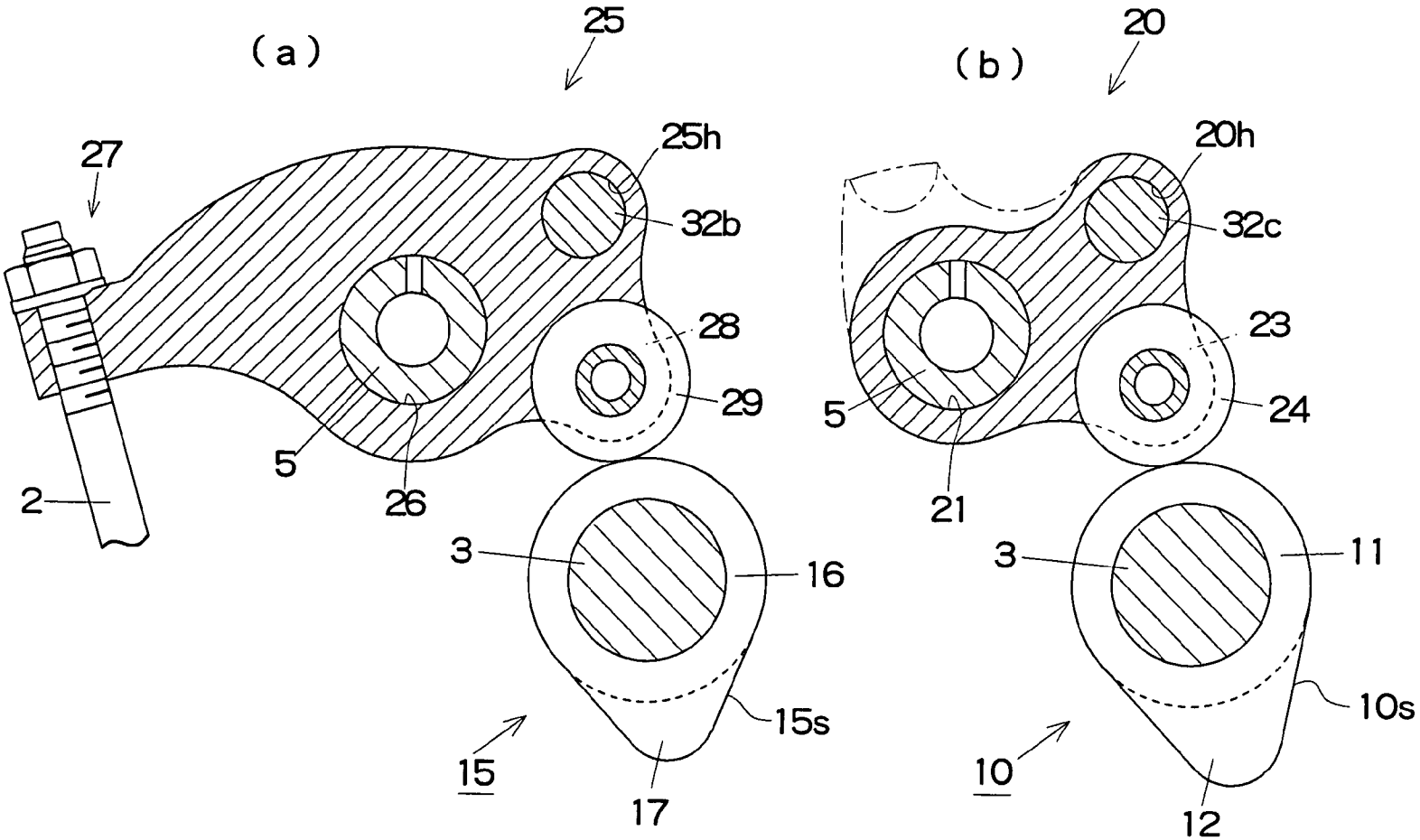
FIGS. 2A and 2B are sectional views that respectively show a high-speed rocker arm and a low-speed rocker arm in the variable valve mechanism according to the present invention.

A low-speed cam 10 and a high-speed cam 15 are arranged in parallel, and a low-speed rocker arm 20 that is driven by the low-speed cam 10 and a high-speed rocker arm 25 that is driven by the high-speed cam 15 are also arranged in parallel. A cam profile H of the high-speed cam 15 is set such that it does not exceed a cam profile L of the low-speed cam 10. During low-speed operation, the low-speed rocker arm 20 and the high-speed rocker arm 25 are linked such that the low-speed cam 10 causes the high-speed rocker arm 25 to rock together with the low-speed rocker arm 20 and to open and close a valve 2. During high-speed operation, the low-speed rocker arm 20 and the high-speed rocker arm 25 are de-linked such that the low-speed cam 10 causes the low-speed rocker arm 20 to rock idly, while the high-speed cam 15 causes the high-speed rocker arm 25 to rock independently and to open and close the valve 2. The cam profile L of the low-speed cam 10 is set such that the valve closes later than it does with the cam profile of the high-speed cam 15.

EXAMPLE

A variable valve mechanism 9 according to the present invention will be explained below, based on FIGS. 1 to 5, as a specific embodiment in an internal combustion engine that has two intake valves and two exhaust valves per cylinder. Note that the configuration is the same for both the intake valves and the exhaust valves, so only the configuration on the intake valve side will be illustrated and explained.

The variable valve mechanism 9 is configured such that it includes the low-speed cam 10, the high-speed cam 15, the low-speed rocker arm 20, the high-speed rocker arm 25, and a switching mechanism 30. The low-speed cam 10 and the high-speed cam 15 are arranged in parallel on a single camshaft 3. The low-speed rocker arm 20 and the high-speed rocker arm 25 are arranged in parallel on a rocker shaft 5 that is supported by a support 4, and are driven by the cams. The switching mechanism 30 switches the operation of the valve 2 by linking and de-linking the two rocker arms.

The low-speed cam 10 is configured such that it includes a base circle portion 11 that serves as a base portion and a cam nose 12 that protrudes from the base circle portion 11. A cam face 10*s* that contacts the low-speed rocker arm 20 is formed on an outer peripheral surface of the low-speed cam 10.

The high-speed cam 15 is configured such that it includes a base circle portion 16 that is of the same size and shape as the base circle portion 11 of the low-speed cam 10 and a cam nose 17 that protrudes from the base circle portion 16. A cam face 15*s* that contacts the high-speed rocker arm 25 is formed on an outer peripheral surface of the high-speed cam 15.

Figure 4A:
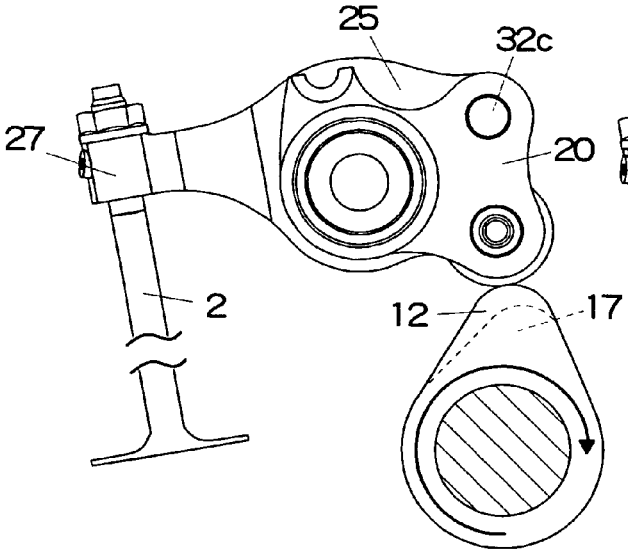
FIGS. 4A and 4B are frontal views that respectively show a low-speed state and a high-speed state of the variable valve mechanism according to the present invention.
Figure 4B:
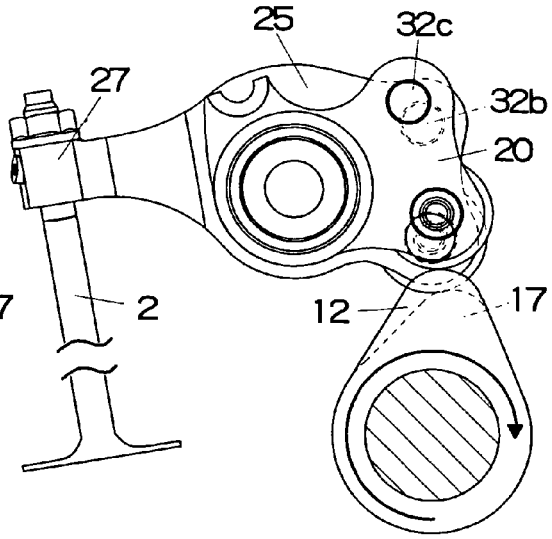
Figure 4C:
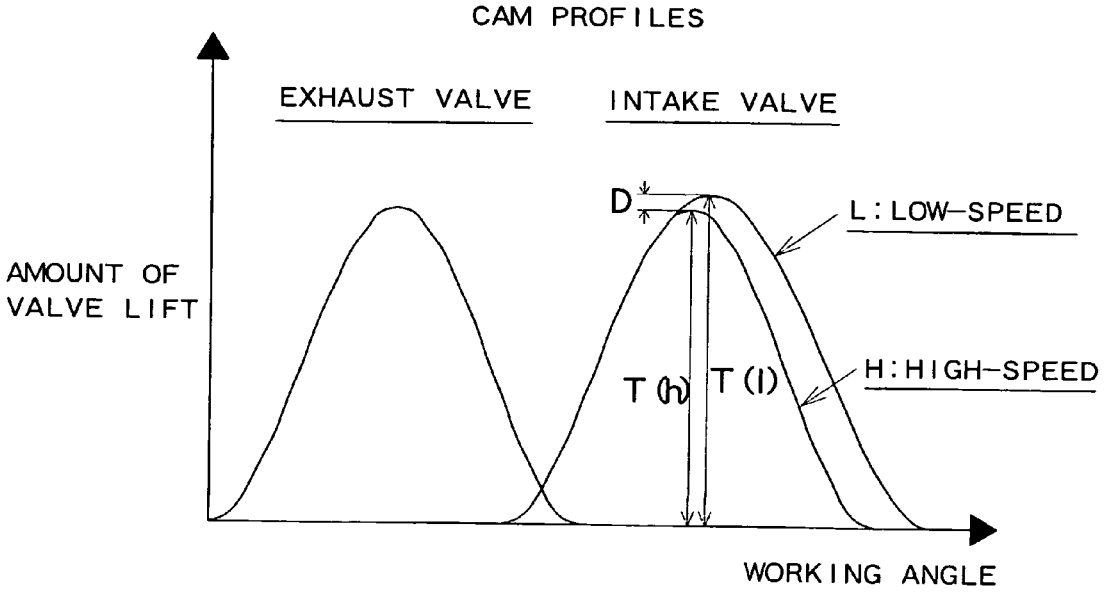
FIG. 4C is a graph that shows cam profiles at low speed and at high speed.

The cam profile H of the high-speed cam 15, as shown in FIG. 4C, is set such that it does not exceed the cam profile L of the low-speed cam 10. Further, the cam profile L of the low-speed cam 10 is set such that the valve closes later than it does with the cam profile H of the high-speed cam 15. In this example, the height T(h) of the nose of the high-speed cam is approximately 9.6 mm, and the height T(l) of the nose of the low-speed cam is approximately 10.0 mm, for example. Because the difference D between the two heights is thus set to a small value of approximately 0.4 mm, a sufficient amount of valve lift can be ensured during high-speed operation.

The rocker arms are arranged substantially in contact and in parallel with each other such that, in order starting from the support 4, the high-speed rocker arm 25 comes first and the low-speed rocker arm 20 comes second.

The high-speed rocker arm 25 is configured such that it includes a shaft hole 26, a valve attachment portion 27, a fork 28, and a roller 29. The shaft hole 26 is formed in the center of the high-speed rocker arm 25, and the rocker shaft 5 is inserted through it. The valve attachment portion 27 is formed at a distal end of the high-speed rocker arm 25. The fork 28 is formed in a lower portion of a proximal end of the high-speed rocker arm 25 and supports the roller 29 from both sides. The roller 29 contacts the cam nose 17 of the high-speed cam 15.

The low-speed rocker arm 20 is configured such that it includes a shaft hole 21, a fork 23, and a roller 24, but does not include the valve attachment portion 27. The shaft hole 21 is formed from the center to a distal end of the low-speed rocker arm 20, and the rocker shaft 5 is inserted through it. The fork 23 is formed in a lower portion of a proximal end of the low-speed rocker arm 20 and supports the roller 24 from both sides. The roller 24 contacts the cam nose 12 of the low-speed cam 10.

The rollers in the rocker arms may take the form of examples (1) and (2) below.

Figure 5B:
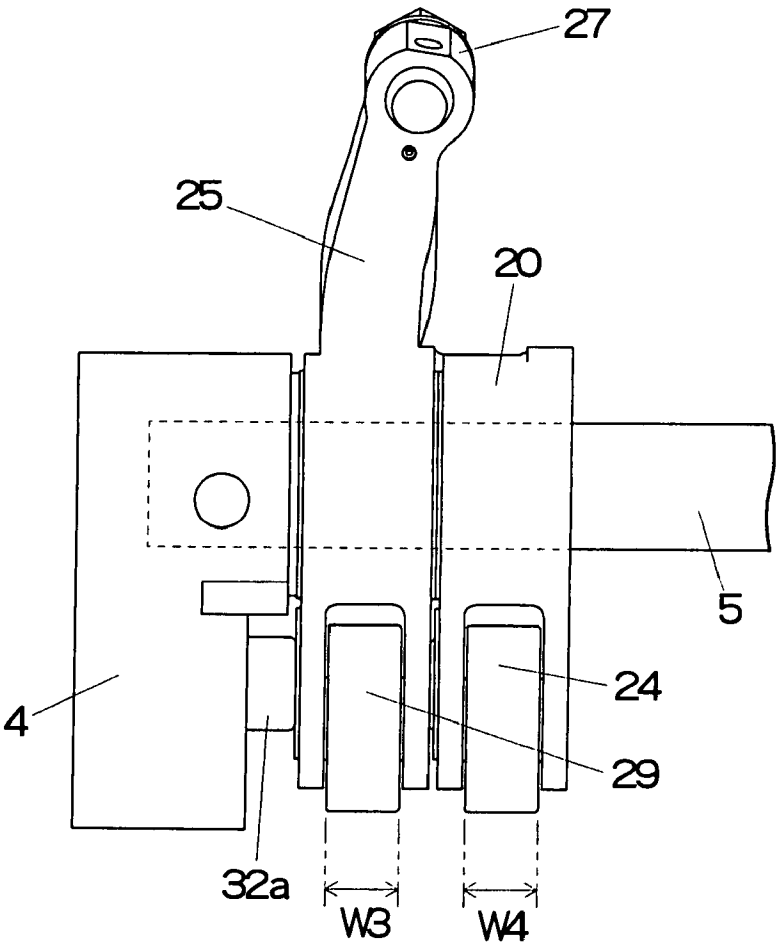
FIGS. 5A and 5B are bottom views that respectively show a form of the variable valve mechanism according to the present invention.
Figure 5A:
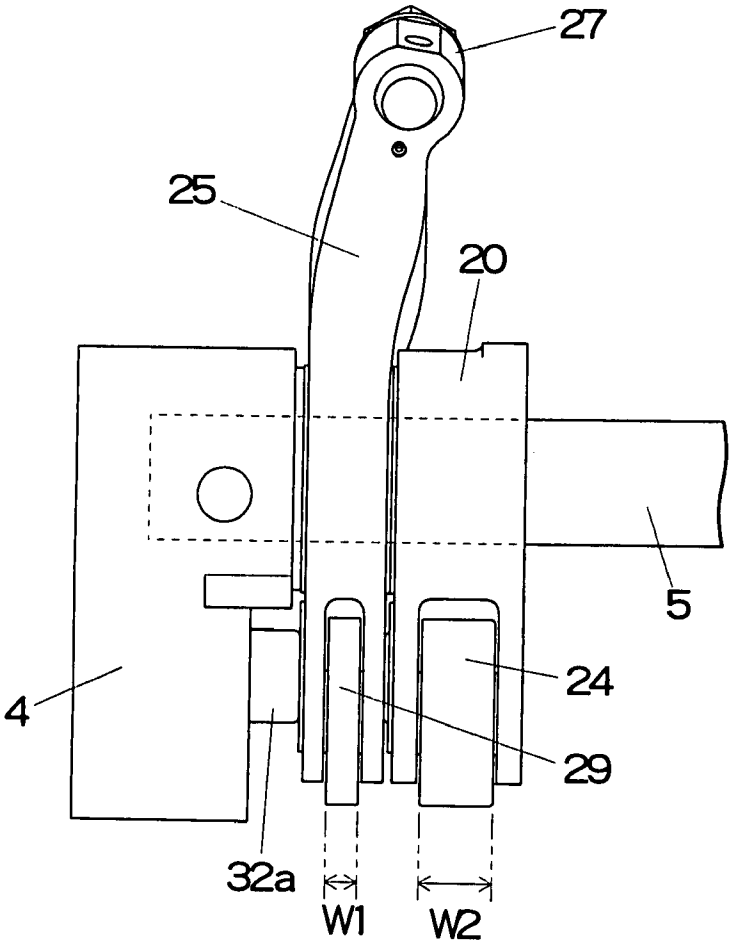

(1) As shown in FIG. 5A, a width W1 of the roller in the high-speed rocker arm, which opens and closes the valve, is made smaller than a width W2 of the roller in the low-speed rocker arm in order to reduce the inertial mass involved during high-speed operation.

(2) As shown in FIG. 5B, a width W3 of the roller in the high-speed rocker arm, which opens and closes the valve, is made equal to or greater than a width W4 of the roller in the low-speed rocker arm so that the high-speed rocker arm can handle a greater amount of lift in a stable manner.

Note that either of the above examples (1) and (2) may be used, depending on the objective.

At low speed, the switching mechanism 30 links the low-speed rocker arm 20 and the high-speed rocker arm 25 such that the low-speed cam 10 causes the high-speed rocker arm 25 to rock together with the low-speed rocker arm 20 and to open and close the valve 2. At high speed, the switching mechanism 30 de-links the low-speed rocker arm 20 and the high-speed rocker arm 25 such that the low-speed cam 10 causes the low-speed rocker arm 20 to rock idly, while the high-speed cam 15 causes the high-speed rocker arm 25 to rock independently and to open and close the valve 2. The switching mechanism 30 is configured such that it includes pin holes 4*h*, 20*h*, 25*h* that are formed in the support 4 and in the rocker arms, a linking pin 32 that travels in a reciprocating motion through the pin holes 4*h*, 20*h*, 25*h*, an oil passage 31 that imparts a hydraulic pressure that presses the linking pin 32 in one direction, and a coil spring 33 that energizes the linking pin 32 in another direction.

The linking pin 32 is configured such that it includes an input pin 32*a*, a center pin 32*b*, and a pusher pin 32*c*. The input pin 32*a* is pressed by an oil O that is discharged from the oil passage 31. An end face of the center pin 32*b* contacts the input pin 32*a*. The pusher pin 32*c* contacts another end face of the center pin 32*b*. The pin hole 4*h* is provided as a concavity on the side of the support 4 that faces the low-speed rocker arm 20, and the input pin 32*a* is accommodated in the pin hole 4*h* such that the input pin 32*a* can slide. The pin hole 25*h* is provided such that it passes through an upper portion of the proximal end of the high-speed rocker arm 25, and the center pin 32*b* is accommodated in the pin hole 25*h* such that the center pin 32*b* can slide. The pin hole 20*h* is provided as a concavity in an upper portion of the proximal end of the low-speed rocker arm 20. The cup-shaped pusher pin 32*c* is accommodated in the pin hole 20*h* such that the pusher pin 32*c* can slide, and the coil spring 33 is also accommodated in the pin hole 20*h*. The coil spring 33 energizes the pusher pin 32*c* toward the center pin 32*b*.

The oil passage 31 is provided from a cylinder head or an oil supply pipe to the support 4 and from the support 4 to the pin hole 4*h*. When the oil O is supplied to the oil passage 31, the hydraulic pressure of the oil O presses on the input pin 32*a*.

The operation of the low-speed rocker arm 20 and the high-speed rocker arm 25 by the switching mechanism 30 will be explained below.

(a) Low-Speed Operation

Figure 3A:
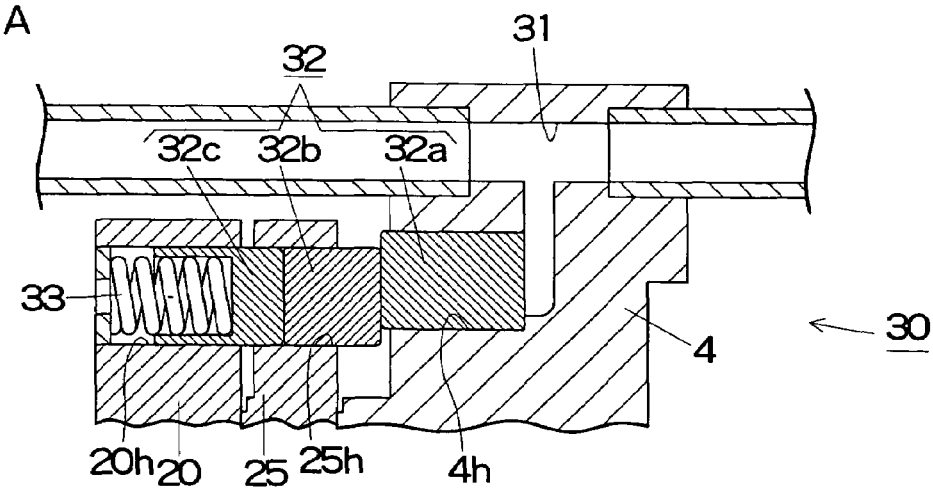
FIGS. 3A and 3B are sectional views that show a switching mechanism of the variable valve mechanism according to the present invention.

When the revolution speed is not greater than 3000 rpm, for example, and the throttle angle is small, the oil O is not supplied from the oil passage 31, and the pusher pin 32*c* is energized by the coil spring 33 such that the pusher pin 32*c* straddles the boundary between the pin holes 20*h*, 25*h* in the two rocker arms, as shown in FIG. 3A. At this time, the two rocker arms are linked. As shown in FIG. 4A, the low-speed cam 10 causes the high-speed rocker arm 25 to rock together with the low-speed rocker arm 20 and to open and close the valve 2. At this time, the high-speed cam 15 swings idly, without touching the high-speed rocker arm 25.

(b) High-Speed Operation

Figure 3B:
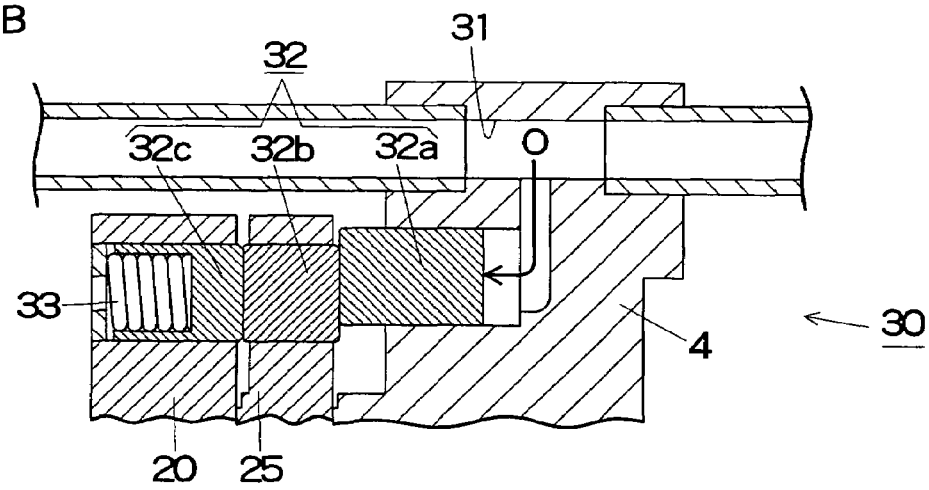

When the revolution speed is at least 3000 rpm, for example, and when the throttle angle is large (when the degree of acceleration is high), even if the revolution speed is less than 3000 rpm, the oil O is supplied from the oil passage 31, and the input pin 32*a* is pushed by the hydraulic pressure toward the center pin 32*b*, as shown in FIG. 3B. The pusher pin 32*c* is thus pressed, and when it contacts the bottom face of the pin hole 20*h* and stops, the boundary between the center pin 32*b* and the pusher pin 32*c* is aligned with the boundary between the two rocker arms 20, 25. At this time, the two rocker arms 20, 25 are de-linked. Next, as shown in FIG. 4B, the low-speed cam 10 causes the low-speed rocker arm 20 to rock idly, while the high-speed cam 15 causes the high-speed rocker arm 25 to rock independently and to open and close the valve 2.

Next, a valve timing switching mechanism that makes it possible to delay the valve closing is realized by using the cam profile L of the low-speed cam 10, the cam profile H of the high-speed cam 15, and the above-described switching mechanism 30. Specifically, by setting the cam profile L of the low-speed cam 10 such that the valve closes later than with the cam profile H of the high-speed cam 15, the valve timing switching mechanism makes the closing of the valve 2 relatively late during low-speed operation, thus switching the opening and closing timings of the valve 2. FIG. 4C shows an example of the cam profiles when the mechanism is used on the intake valve side.

The effects below are obtained by the variable valve mechanism 9 according to the present example.

Figure 3C:
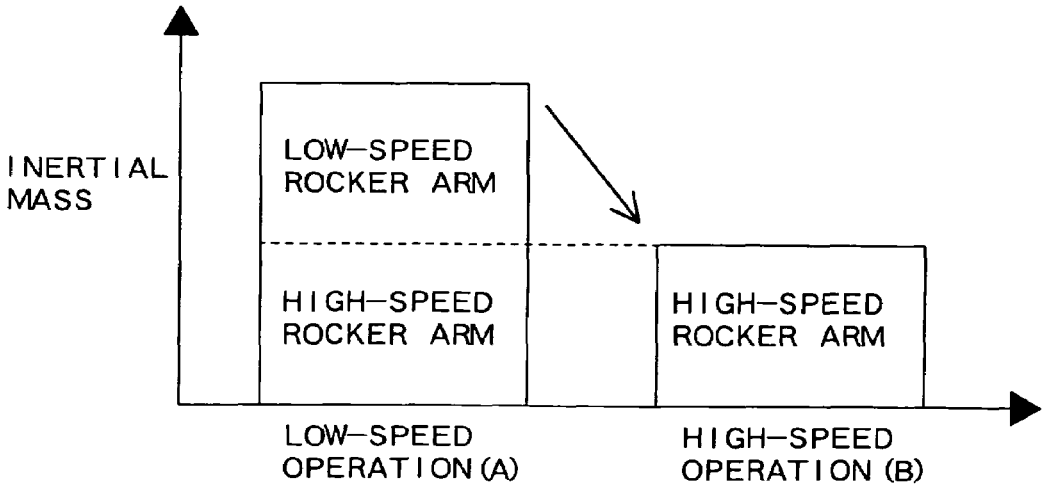
FIG. 3C is a graph that shows an inertial mass before and after switching.

(1) A simple structure can be used to make the inertial mass during high-speed operation lower than during low-speed operation, as shown in FIG. 3C. (For example, approximately 30% lower mass can be expected during high-speed operation.) The valve spring load can therefore be reduced. (For example, approximately 30% less load can be expected.) Moreover, even in a case where the valve spring load is maintained at the current level, the structure is an effective way to meet demands for better performance at higher revolution speeds and the like.

(2) Closing the valve 2 later during low-speed operation can reduce pumping loss and improve fuel economy.

(3) Because the oil O is supplied and the switching is done in the high-speed range, where ample hydraulic pressure is provided, structural measures to deal with hydraulic pressure drops are rendered unnecessary.

Note that the present invention is not limited by the example described above and may be appropriately modified and practiced within the scope of the appended claims or the equivalents thereof.

What is claimed is:

1. A variable valve mechanism comprising:

a low-speed cam and a high-speed cam that are arranged in parallel;

a low-speed rocker arm that is driven by the low-speed cam and a high-speed rocker arm that is driven by the high-speed cam, the two rocker arms being arranged in parallel; and a switching mechanism;

wherein a cam profile of the high-speed cam is set such that it does not exceed a cam profile of the low-speed cam, wherein during low-speed operation, the switching mechanism links the low-speed rocker arm and the high-speed rocker arm such that the low-speed cam causes the high-speed rocker arm to rock together with the low-speed rocker arm and to open and close a valve, and during high-speed operation, the switching mechanism de-links the low-speed rocker arm and the high-speed rocker arm such that the low-speed cam causes the low-speed rocker arm to rock idly and the high-speed cam causes the high-speed rocker arm to rock independently and to open and close the valve, and wherein the cam profile of the low-speed cam is set such that the valve closes later than it does with the cam profile of the high-speed cam.

2. The variable valve mechanism according to claim 1, wherein a height of a nose of the high-speed cam is equal to a height of a nose of the low-speed cam.

3. The variable valve mechanism according to claim 1, wherein a height of a nose of the high-speed cam is lower than a height of a nose of the low-speed cam by 0.1 to 0.6 mm.

* * * * *